US010838443B2

(12) United States Patent
Rasmus

(10) Patent No.: US 10,838,443 B2
(45) Date of Patent: Nov. 17, 2020

(54) PRECISION BANDGAP REFERENCE WITH TRIM ADJUSTMENT

(71) Applicant: QUALCOMM Incorporated, San Diego, CA (US)

(72) Inventor: Todd Morgan Rasmus, Cary, NC (US)

(73) Assignee: Qualcomm Incorporated, San Diego, CA (US)

( * ) Notice: Subject to any disclaimer, the term of this patent is extended or adjusted under 35 U.S.C. 154(b) by 0 days.

(21) Appl. No.: 16/211,178

(22) Filed: Dec. 5, 2018

(65) Prior Publication Data

US 2020/0183440 A1 Jun. 11, 2020

(51) Int. Cl.
*G05F 1/46* (2006.01)

(52) U.S. Cl.
CPC ..... *G05F 1/463* (2013.01); *G05F 1/46* (2013.01); *G05F 1/461* (2013.01)

(58) Field of Classification Search
CPC . G05F 1/46; G05F 1/461; G05F 1/462; G05F 1/463; G05F 3/20; G05F 1/575
See application file for complete search history.

(56) References Cited

U.S. PATENT DOCUMENTS 7,913,012 B2 3/2011 Piasecki et al.
8,022,751 B2 9/2011 Le et al.
8,710,898 B1 * 4/2014 Chiang ..... H03F 1/301 327/362
9,261,415 B1 * 2/2016 Zhang ..... G05F 3/30
2003/0006747 A1 1/2003 Jaussi et al.
2005/0127987 A1 6/2005 Sato et al.
2005/0194957 A1 9/2005 Brokaw
2007/0252573 A1 * 11/2007 Tachibana ..... G05F 3/30 323/313
2008/0116875 A1 5/2008 Ma
2011/0227636 A1 9/2011 Endo et al.
2014/0203794 A1 7/2014 Pietri et al.
2016/0266598 A1 9/2016 Wong et al.
2017/0115677 A1 * 4/2017 Caffee ..... G05F 1/575

OTHER PUBLICATIONS

Cai C., et al., "A High Accuracy Low-Power Bandgap Voltage Rreference with Trimming," 12th IEEE International Conference on Solid-State and Integrated Circuit Technology (ICSICT), 2014, 4 Pages.
Ekekwe N., et al., "A 5-bits Precision CMOS Bandgap Reference with On-Chip Bi-directional Resistance Trimming," IEEE 51st Midwest Symposium on Circuits and Systems, 2008, pp. 257-260.
Lu F., et al., "Ultra-High Precision Bandgap Voltage Reference Using a Novel Current Trimming Technique," 13th IEEE International Conference on Solid-State and Integrated Circuit Technology (ICSICT), 2016, 4 Pages.
International Search Report and Written Opinion—PCT/US2019/057590—ISA/EPO—dated Feb. 3, 2020.

* cited by examiner

*Primary Examiner* — Alex Torres-Rivera
(74) *Attorney, Agent, or Firm* — Qualcomm Incorporated

(57) ABSTRACT

Aspects of the disclosure are directed to generating a reference voltage with trim adjustment. Accordingly, a reference voltage with trim adjustment is generating which involves generating a trim current using at least one of a plurality of selectable parallel elements; inputting the trim current to parallel resistor branches to generate a first scaled voltage; and combining a first voltage with the first scaled voltage to generate the reference voltage.

21 Claims, 9 Drawing Sheets

PRECISION BANDGAP REFERENCE WITH TRIM ADJUSTMENT

TECHNICAL FIELD

This disclosure relates generally to the field of reference voltage generation, and, in particular, to a precision bandgap reference with trim adjustment.

BACKGROUND

A reference voltage in electronic circuits is a signal at a fixed voltage value which may be used for calibration purposes. That is, other signals may be compared with the reference voltage, or other signals may be generated from the reference voltage. The reference voltage should have high stability (i.e., robustness against environmental change) and good accuracy (i.e., small difference relative to a desired voltage value). A bandgap reference voltage source generates a reference voltage that is substantially constant over a defined voltage supply and temperature range. Integrated circuit (IC) applications often rely on the accuracy of this reference to allow the highest possible system performance. However, bandgap reference voltage references are subject to tolerance error due to an imperfect silicon fabrication process which can alter the individual device parameters of the transistors and resistors which comprise the bandgap reference. Hence, a trimming procedure is required to mitigate these inaccuracies and restore the accuracy of the bandgap reference.

SUMMARY

The following presents a simplified summary of one or more aspects of the present disclosure, in order to provide a basic understanding of such aspects. This summary is not an extensive overview of all contemplated features of the disclosure, and is intended neither to identify key or critical elements of all aspects of the disclosure nor to delineate the scope of any or all aspects of the disclosure. Its sole purpose is to present some concepts of one or more aspects of the disclosure in a simplified form as a prelude to the more detailed description that is presented later.

In one aspect, the disclosure provides precision bandgap reference with trim adjustment. Accordingly, a method for generating a reference voltage with trim adjustment, the method including generating a trim current using at least one of a plurality of selectable parallel elements; inputting the trim current to parallel resistor branches to generate a first scaled voltage; and combining a first voltage with the first scaled voltage to generate the reference voltage.

In one example, the method may further include generating the first voltage, wherein the first voltage has a negative temperature coefficient. In one example, the method may further include generating a second voltage, wherein the second voltage has a positive temperature coefficient. In one example, the method may further include using a common amplifier for generating the second voltage. In one example, the method may further include scaling the second voltage to generate a second scaled voltage, wherein the second scaled voltage includes a voltage offset. In one example, the method may further include using a n-bit binary word for selecting the at least one of the plurality of selectable parallel elements. In one example, the method may further include using a diode array for generating the first scaled voltage.

In one example, the trim current tracks the second scaled voltage over temperature. In one example, the first scaled voltage is the second scaled voltage with the voltage offset removed. In one example, the voltage offset is a constant voltage offset. In one example, the first voltage is a complementary to absolute temperature (CTAT) voltage. In one example, the second voltage is a proportional to absolute temperature (PTAT) voltage. In one example, the plurality of selectable parallel elements is selected for usage prior to an operational use. In one example, the plurality of selectable parallel elements is weighted.

Another aspect of the disclosure provides an apparatus for generating a reference voltage with trim adjustment, the method including means for generating a trim current using at least one of a plurality of selectable parallel elements; means for inputting the trim current to parallel resistor branches to generate a first scaled voltage; and means for combining a first voltage with the first scaled voltage to generate the reference voltage.

In one example, the apparatus may further include means for generating the first voltage, wherein the first voltage has a negative temperature coefficient. In one example, the apparatus may further include means for generating a second voltage, wherein the second voltage has a positive temperature coefficient. In one example, the apparatus may further include a common amplifier for generating the second voltage. In one example, the apparatus may further include means for scaling the second voltage to generate a second scaled voltage, wherein the second scaled voltage includes a voltage offset. In one example, the apparatus may further include means for removing the voltage offset from the second scaled voltage to generate the first scaled voltage. In one example, the apparatus may further include a n-bit binary word for selecting the at least one of the plurality of selectable parallel elements, and a diode array for generating the first scaled voltage. In one example, the first voltage is a complementary to absolute temperature (CTAT) voltage and the second voltage is a proportional to absolute temperature (PTAT) voltage.

Another aspect of the disclosure provides a circuit for generating a reference voltage with trim adjustment, the method including a transconductance gain stage for generating a trim current using at least one of a plurality of selectable parallel elements, and for inputting the trim current to parallel resistor branches to generate a first scaled voltage; a complementary to absolute temperature (CTAT) circuit for generating a first voltage, wherein the first voltage has a negative temperature coefficient; and a proportional to absolute temperature (PTAT) circuit for combining the first voltage with the first scaled voltage to generate the reference voltage.

In one example, the circuit may further include a n-bit binary word for selecting the at least one of the plurality of selectable parallel elements. In one example, the circuit may further include a diode array for generating the first scaled voltage.

In one example, the proportional to absolute temperature (PTAT) circuit generates a second voltage with a positive temperature coefficient. In one example, the proportional to absolute temperature (PTAT) circuit includes a common amplifier for generating the second voltage. In one example, the proportional to absolute temperature (PTAT) circuit scales the second voltage to generate a second scaled voltage with a voltage offset. In one example, the proportional to absolute temperature (PTAT) circuit removes the voltage offset from the second scaled voltage to generate the first scaled voltage.

Another aspect of the disclosure provides A computer-readable medium storing computer executable code, operable on a device including at least one processor and at least one memory coupled to the at least one processor, wherein the at least one processor is configured to generate a reference voltage with trim adjustment, the computer executable code including instructions for causing a computer to generate a trim current using at least one of a plurality of selectable parallel elements; instructions for causing the computer to input the trim current to parallel resistor branches to generate a first scaled voltage; and instructions for causing the computer to combine a first voltage with the first scaled voltage to generate the reference voltage.

These and other aspects of the disclosure will become more fully understood upon a review of the detailed description, which follows. Other aspects, features, and implementations of the present disclosure will become apparent to those of ordinary skill in the art, upon reviewing the following description of specific, exemplary implementations of the present invention in conjunction with the accompanying figures. While features of the present invention may be discussed relative to certain implementations and figures below, all implementations of the present invention can include one or more of the advantageous features discussed herein. In other words, while one or more implementations may be discussed as having certain advantageous features, one or more of such features may also be used in accordance with the various implementations of the invention discussed herein. In similar fashion, while exemplary implementations may be discussed below as device, system, or method implementations it should be understood that such exemplary implementations can be implemented in various devices, systems, and methods.

DETAILED DESCRIPTION

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details. In some instances, well known structures and components are shown in block diagram form in order to avoid obscuring such concepts.

While for purposes of simplicity of explanation, the methodologies are shown and described as a series of acts, it is to be understood and appreciated that the methodologies are not limited by the order of acts, as some acts may, in accordance with one or more aspects, occur in different orders and/or concurrently with other acts from that shown and described herein. For example, those skilled in the art will understand and appreciate that a methodology could alternatively be represented as a series of interrelated states or events, such as in a state diagram. Moreover, not all illustrated acts may be required to implement a methodology in accordance with one or more aspects.

Figure 1:
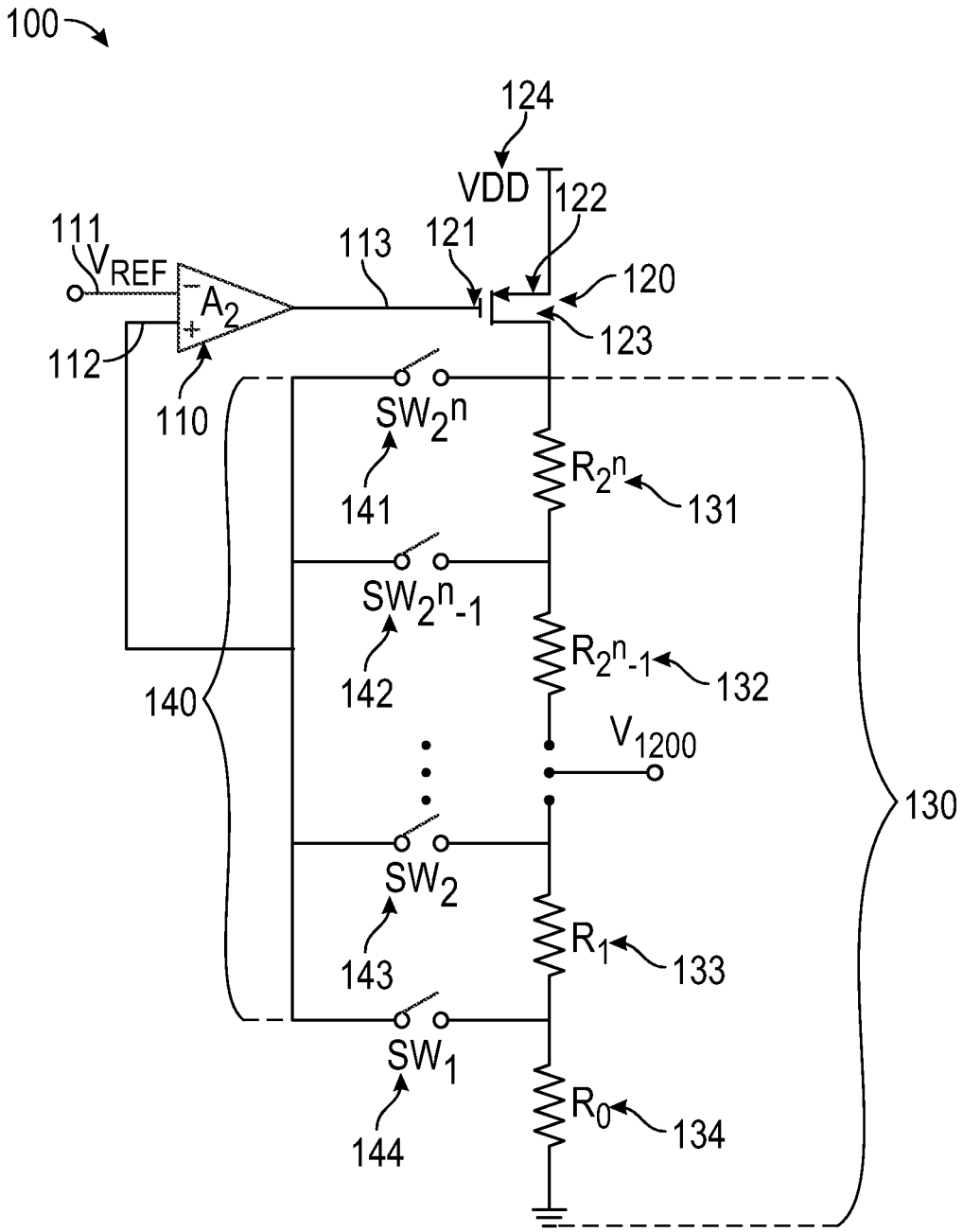
FIG. 1 illustrates a first example of a voltage circuit with trimming.

The present disclosure discloses a bandgap reference voltage circuit for producing a reference voltage which minimizes tolerance error due to device mistracking. It is also desirable that the reference voltage be stable against environmental conditions and over time. Also, it is desirable that the reference voltage be accurate; that is, its voltage value should be close to a desired voltage value. Integrated circuits (IC) such as a system on a chip (SOC) may require a reference voltage with high stability and good accuracy for internal circuit usage. In one aspect, obtaining such a reference voltage may be achieved by using a bandgap reference voltage. In one aspect, the bandgap reference voltage relies on semiconductor physics, specifically on the 1.22 eV bandgap voltage of silicon at zero degrees Kelvin (0 K), to provide a well-defined reference voltage for electronic circuits. In one example, the bandgap reference voltage may be generated by combining (e.g., summing) a complementary to absolute temperature (CTAT) voltage and a proportional to absolute temperature (PTAT) voltage FIG. 1 illustrates a first example of a voltage circuit 100 with trimming. The voltage circuit 100 includes an op amp 110, a transistor 120, a cascaded resistor network 130 and a plurality of switches 140. In one example, the op amp 110 has a reference voltage VREF supplied to an inverting (minus) terminal 111 and a feedback voltage supplied to a non-inverting (plus) terminal 112. An output 113 of the op amp 110 is supplied to a gate terminal 121 of a transistor 120. A bias voltage VDD 124 is supplied to a source terminal 122 of the transistor 120 and a drain terminal 123 of the transistor 120 is connected to a cascaded resistor network 130.

In one example, the cascaded resistor network 130 is includes a plurality of resistors connected in series: $R_2''$ 131, $R_{2-1}''$ 132, . . . , $R_1$ 133, $R_0$ 134. Although in the example of FIG. 1, four resistors are explicitly shown in the cascaded resistor network 130, one skilled in the art would understand that the quantity of the resistors is not limiting and the more or less quantity of resistors in the cascaded resistor network 130 is within the scope and spirit of the present disclosure.

In addition, each resistor includes one terminal connected to a switch, wherein the switch is part of a plurality of switches 140 denoted as $SW_2''$ 141, $SW_{2-1}''$ 142, . . . $SW_2$ 143, $SW_1$144. In one example, each of the plurality of switches 140 may be used to engage or disengage each resistor of the cascaded resistor network 130 for contributing to the feedback voltage. In one example, the plurality of switches 140 is used to provide trimming of the reference voltage.

Figure 2:
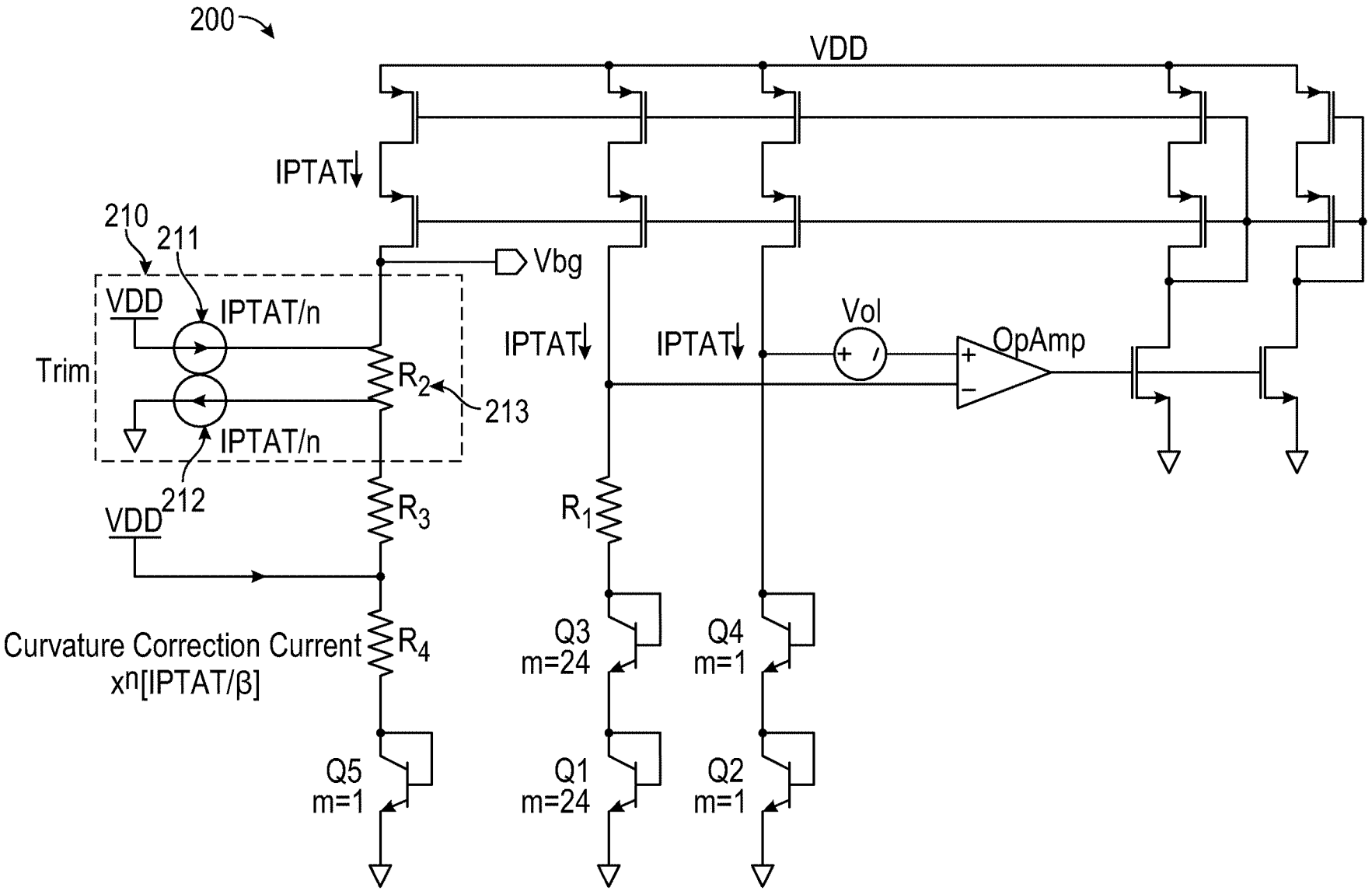
FIG. 2 illustrates a second example of a voltage circuit with trimming.

FIG. 2 illustrates a second example of a voltage circuit 200 with trimming. In one example, the voltage circuit 200 includes a trim circuit 210. In one example, the trim circuit 210 uses a first current source 211 as an input to a resistor R2 213 and a second current source 212 as an output from resistor R2 213.

Figure 3:
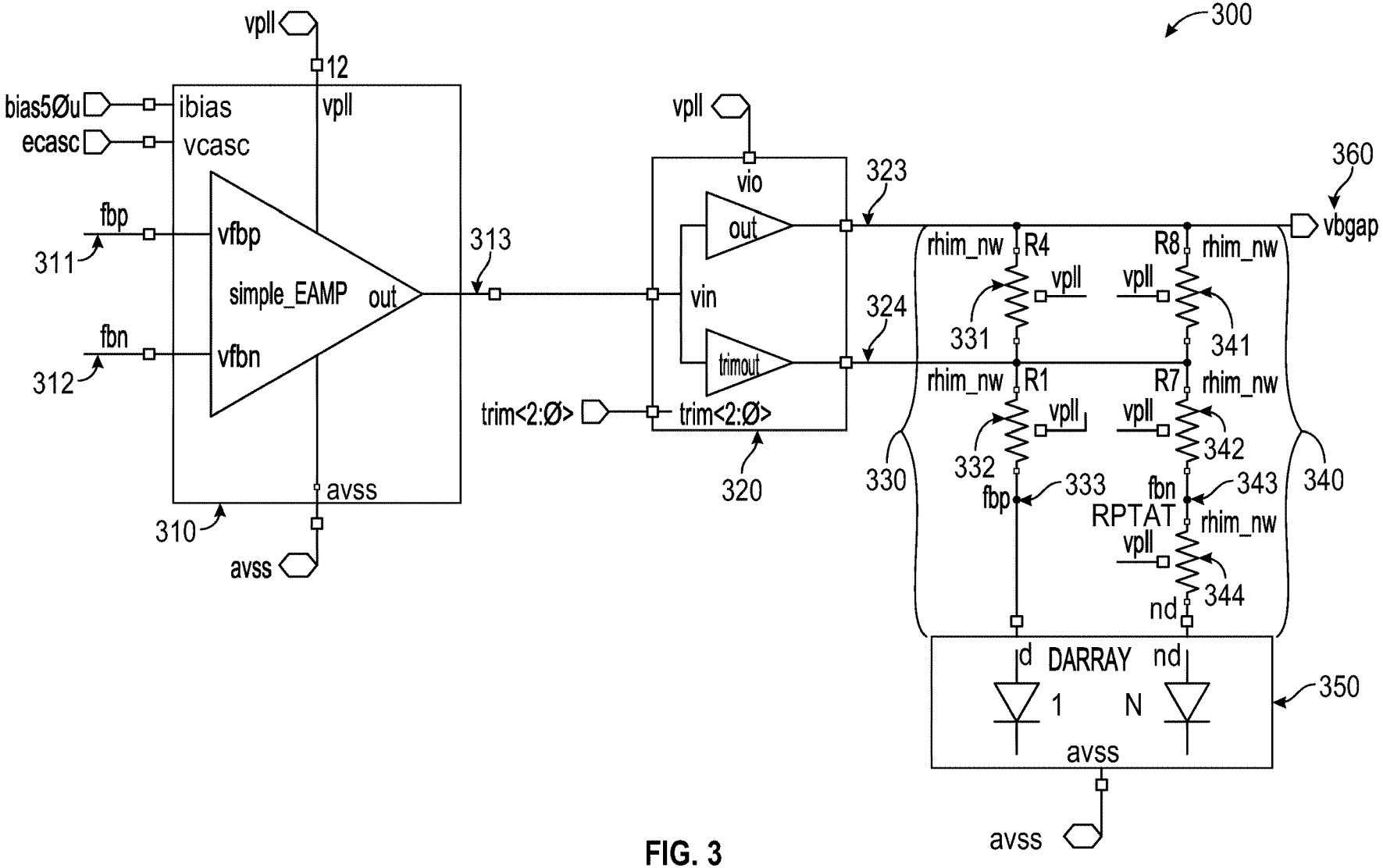
FIG. 3 illustrates an example of a negative feedback loop circuit for generating a reference voltage.

FIG. 3 illustrates an example of a bandgap voltage reference circuit 300 which incorporates negative feedback loop circuit for generating a reference voltage. In one example, the bandgap voltage reference circuit includes a differential error amplifier 310, a transconductance (e.g., voltage input, current output) gain stage 320, a first resistor branch 330, a second resistor branch 340, and a diode array (DARRAY) 350. In one example, the first resistor branch 330 and the second resistor branch 340 form a two-parallel resistor branches.

In one example, the differential error amplifier 310 (e.g., operational amplifier) provides a voltage Vout 313 which is proportional to a difference voltage between a first amplifier input fbp 311 and a second amplifier input fbn 312. In one example, the differential error amplifier 310 has an open loop gain G from the difference voltage to the amplifier output Vout 313. For example, the amplifier output may be expressed as Vout=G(fbp−fbn).

In one example, the differential error amplifier 310 is part of the bandgap voltage reference circuit 300 which incorporates negative feedback, where the differential error amplifier 310 accepts two inputs, the first amplifier input fbp 311 from a first resistor branch and the second amplifier input fbn 312 from a second resistor branch. The output 313 of the differential error amplifier 310 provides a voltage to the input of a transconductance gain stage 320, which in turn provides bias current equally to the two resistors branches, the first resistor branch 330 and the second resistor branch 340, using current outputs 323 and 324. The transconductance gain corresponding to current output 324 of transconductance gain stage 320 is adjustable (e.g., trimmable), determined by the state set by a trim<2:0> vector input. The transconductance gain corresponding to current output 323 of transconductance gain stage 320 is not adjusted by the input trim<2:0> vector input. Further, both current outputs 323 and 324 are proportional to the output voltage of the differential error amplifier 310, in which only the proportional gain of output 324 set by the trim<2:0> vector input.

Figure 4:
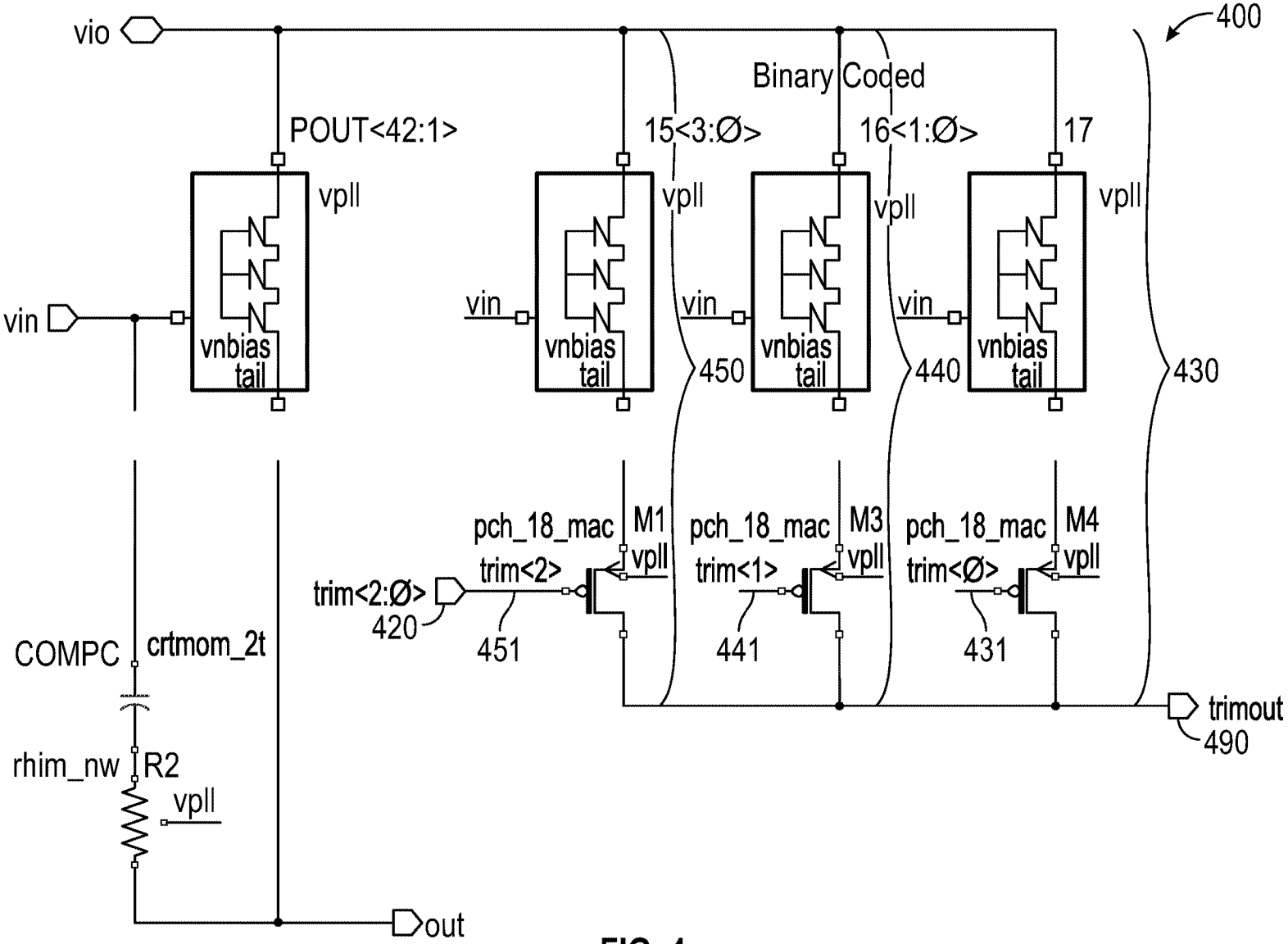
FIG. 4 illustrates an example of a digital trim circuit with parallel finger elements.

In one example, the transconductance gain stage 320 uses an n-bit binary command "trim<n−1:0>" 323 to control the selection or deselection of a plurality of n parallel finger elements, shown in detail in FIG. 4 for the specific case of n=3. One skilled in the art would understand that having n=3 is an example, and that other quantities for n are also within the scope and spirit of the present disclosure. In one example, the n-bit binary command may be set at the time of manufacture to adjust voltages such that a bandgap voltage Vbgap 360 reaches a desired target voltage.

In one example, the bandgap voltage Vbgap 360, is set by combining (e.g., summing) a complementary to absolute temperature (CTAT) voltage and a proportional to absolute temperature (PTAT) voltage. The CTAT voltage is derived from the base-emitter junction voltage Vbe of a bipolar junction transistor which has a negative temperature coefficient. The PTAT voltage is derived from the ΔVbe voltage impressed between the anodes of the equally biased diode branches (1 and N) in the diode array 350, according to the classical equation:

$$\Delta Vbe=(kT/q)\ln N$$

where k=Boltzmann's constant=$1.38\times10^{-23}$ J/K,
T=absolute temperature, K
q=electron charge=$1.6\times10^{-19}$ C
ln=natural logarithm function
N=emitter area ratio.

In one example, the first resistor branch 330 is comprised by two resistors 331, 332 connected in series, which further connects to the single (1) diode branch in diode array 350 through node 333. The second resistor branch voltage 340 includes three resistors 341, 342, and 344 connected in series, which further connects to the N diode branch in diode array 350.

In one example, the differential error amplifier 310 is part of the bandgap voltage reference circuit 300 which incorporates negative feedback, where the differential error amplifier 310 accepts two inputs, the first amplifier input fbp 311 from a first resistor branch 330 and the second amplifier input fbn 312 from a second resistor branch 340. Specifically, differential error amplifier 310 input fbp 311 connects to node 333 in first resistor branch 330, whereas input fbn 312 connects to node 343 in second resistor branch 340. These connections comprise a negative feedback path which drives the input fbp311 and fbn 312 of differential error amplifier 310 to the same voltage, assuming the open loop gain of the negative feedback path is sufficiently high. As a result, one skilled in the art will recognize that the same ΔVbe voltage impressed between the anodes of the equally biased diode branches (1 and N) in the diode array 350 now also is impressed across resistor 344 in second resistor branch 340. Because resistor 344 voltage drop is controlled by feedback to be the ΔVbe voltage (PTAT voltage), the currents flowing in first resistor branch 330 and second resistor branch 340 are thus also PTAT. Further, if resistors 331, 341, 333, and 342 are of equal resistance, the currents flowing in first resistor branch 330 and second resistor branch 340 are of equal magnitude. Summing the PTAT voltage drops across each resistor in either resistor branch with the corresponding CTAT Vbe of that branch yields a Vbgap voltage 360 which can be tuned to be largely independent of temperature (with proper nulling of CTAT with PTAT). In one example, the bandgap voltage may be expressed by the following equation:

$$Vbgap=[(1+R_1/R_2)*(\Delta V_{BE}-V_{os})]+V_{BE}$$

where:
$R_1$=resistance sum of resistors 341 and 342
$R_2$=resistance of resistor 344
$\Delta V_{BE}$=delta voltage between 1:N ratioed transistor base-emitter voltages
$V_{os}$=input referred offset voltage impressed between inputs 311 and 312
$V_{BE}$=base-emitter (anode) voltage of diode-connected N transistor The current flowing in each resistor branch is determined by the ratio of $\Delta V_{BE}$ to the resistance of resistor 344, according to the following equation:

$$I_branch=\Delta V_{BE}/R344$$

where:
I_branch=magnitude of current flowing in resistor branches 330 and 340
$\Delta V_{BE}$=delta voltage between 1:N ratioed transistor base-emitter voltages
R344=resistance of resistor 344

In one example, the transconductance gain stage 320 uses binary weighted switched parallel transistor segments controlled by input trim<2:0> to set the transconductance gain corresponding to current output 324. The transconductance gain corresponding to current output 323 is fixed and not controlled by the input trim<2:0>. Further, both current outputs 323 and 324 are proportional to the output voltage of the differential error amplifier 310, and track precisely over temperature, supply voltage, and manufacturing process. The output of differential error amplifier 310, controlled by the feedback loop, determines the proper input voltage to transconductance gain stage 320 which will source the correct amount of IPTAT from both current outputs 323 and 324 required to drive the input fbp311 and fbn 312 of differential error amplifier 310 to the same voltage.

FIG. 4 illustrates an example 400 of one possible embodiment of the transconductance gain stage 320. The output of differential error amplifier 310 impresses a voltage signal on input 410, which is then distributed to a plurality of gate connections to PFET current source elements. Element 420 is a fixed geometry PFET current source which provides an output current to output 421, as determined by the input 410 signal. In one aspect, the example 400 includes selectable parallel elements which may be binary weighted or non-binary weighted. In one example, the selectable parallel elements are parallel connected current source elements 430, 440, 450 as shown in FIG. 4.

In one example, the parallel connected current source elements 430, 440, and 450 form a digitally trimmable network comprised of switchable PFET current source segments which provide output currents to output 490, as determined by the input 410 signal. The PFET geometries current source elements 430, 440, and 450 are binary weighted, i.e., the parallel current source elements are combined with individual geometric scale factors which are integral powers of 2. In one example, the digitally trimmable network uses a n-bit binary encoded vector 'trim<2:0>' 460 to control the selection or deselection of the plurality of n binary weighted current source elements.

In one example, FIG. 4 illustrates a specific case of n=3 binary weighted parallel current source elements. For example, trim<0>431 may control a first current source element 430 with a relative weighting of $2^0$, i.e., unity; trim<1>441 may control a second current source element 440 with a relative weighting of $2^1$, i.e., two; trim<2>451 may control a third current source element 450 with a relative weighting of $2^2$, i.e., four. For example, the n-bit binary command "trim<n−1:0>420 may be used to implement a binary weighted superposition S of selected current source elements, with $$S=\text{trim}<n-1>*2^{n-1}+\ldots+\text{trim}<2>*2^2+\text{trim}<1>*2^1+\text{trim}<0>*2^0$$

Figure 5:
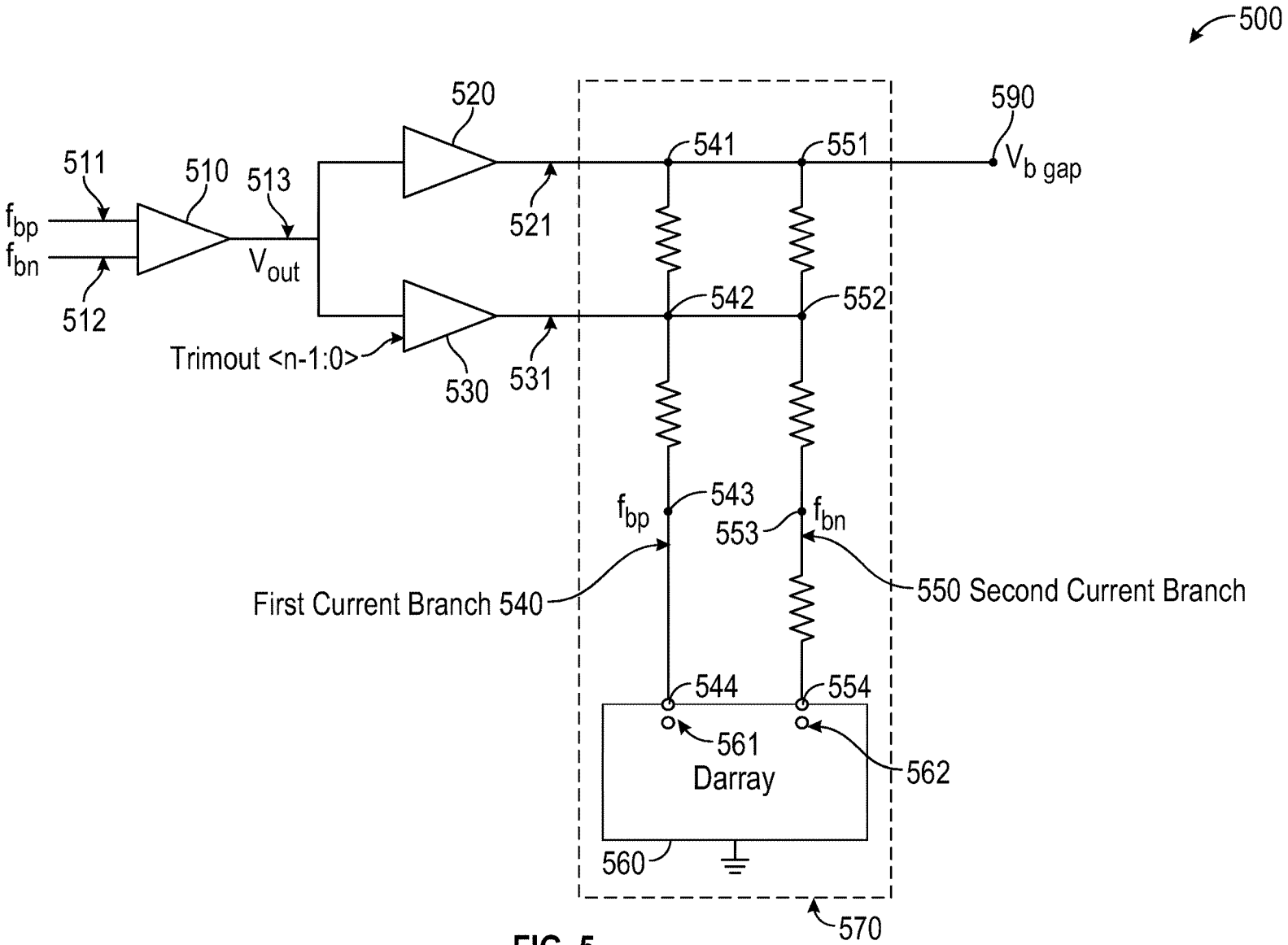
FIG. 5 illustrates an example of a top-level block diagram of a reference voltage generation system.

FIG. 5 illustrates an example of a top-level block diagram of a reference voltage generation system 500. A differential error amplifier 510 accepts a first input fbp 511 and a second input fbn 512 to produce an amplifier output Vout 513. In one example, the amplifier output Vout 513 is related to the first and second amplifier inputs 511, 512 via a differential error amplifier equation:

$$V\text{out}=G(fbp-fbn),$$

where G=open loop amplifier gain. In one example, G>>1 and the differential error amplifier 510 is operated in a feedback configuration.

In one example, the feedback configuration is a negative feedback configuration. In one example, the negative feedback configuration drives the first amplifier input fbp 511 and the second amplifier input fbn 512 towards equality (i.e., fbp=fbn).

In one example, the amplifier output Vout 513 is split into two paths, a primary signal path with a primary transconductance amplifier 520 and a secondary signal path with a secondary transconductance amplifier 530. In one example, the primary signal path and the secondary signal path track each other proportionally over temperature. In one example, the primary signal path and the secondary signal path are connected to both a first current branch 540 and a second current branch 550 of negative feedback path 570. In one example, the negative feedback path 570 is a PTAT circuit.

In one example, a primary output 521 from the primary transconductance amplifier 520 is connected to a first node 541 of the first current branch 540 and the second current branch 550 of the negative feedback path 570. In one example, a secondary output 531 from the secondary transconductance amplifier 530 is connected to a first trim node 542 of the first current branch 540 and the second current branch 550.

In one example, the secondary signal path of the secondary transconductance amplifier 530 is a source of trim current for the negative feedback path 570. In one example, the trim current is selected using selectable parallel elements. In one example, the selectable parallel elements are binary weighted. For example, the binary weighted selectable parallel elements may be selected using an n-bit binary encoded vector. In one example, the selectable parallel elements are selected during manufacturing test, and prior to operational use.

In one example, the diode array 560 employs a plurality of transistors (not shown). In one example, one diode-connected transistor is connected between the input 561 of DARRAY 560 and ground reference, whereas N parallel connected diode-connected transistors are connected between the input 562 of DARRAY 560 and ground reference. Given equal current magnitudes for each current entering the inputs 561 and 562 of DARRAY 560, a voltage offset ΔVbe is impressed between inputs 561 and 562 which is PTAT in nature. In one example, the DARRAY 560 has a forward voltage drop which is a complementary to absolute temperature (CTAT) voltage.

In one example, the negative feedback path 570, with equally biased current magnitudes in first and second current branches 540 and 550, includes a differential voltage ΔVbe which is proportional to absolute temperature T in degrees Kelvin and is dependent on the diode-connected transistor ratio N. For example, $$\Delta Vbe=(kT/q)\ln N$$

where:

k=Boltzmann's constant=$1.38\times10^{-23}$ J/K,

T=absolute temperature, K q=electron charge=$1.6\times10^{-19}$ C ln=natural logarithm function N=emitter area ratio.

In one example, a first feedback node 543 of the first current branch 540 is connected to the first amplifier input fbp 511. In one example, a second feedback node 553 of the second current branch 550 is connected to the second amplifier input fbn 512.

In one example, a first bottom node 544 of the first current branch 540 is connected to a first input 561 of a diode array (e.g., DRRAY 560). In one example, a second bottom node 554 of the second current branch 550 is connected to a second input 562 of the diode array (e.g., DRRAY 560).

In one example, the various nodes of the first current branch 540 are interconnected using resistors. In one example, the various nodes of the second current branch 550 are interconnected using resistors. In one example, all resistances in current branches 540 and 550 are comprised of common matched unit cell (same physical geometries) structures to provide optimal ratio matching over temperature.

In one example, the sum of the currents flowing from the output 521 of the primary transconductance amplifier 520 and from the output 531 of the secondary transconductance amplifier 530 must equal the sum of current flowing into inputs 544 and 554 of DARRAY 560. Further, if no current flows from the output 531 of the secondary transconductance amplifier 530, the output 521 of the primary transconductance amplifier 520 must supply all the current flowing into inputs 544 and 554 of DARRAY 560. Further, the current flow into inputs 544 and 554 of DARRAY 560 are constant, being set by the operation of the negative feedback path 570 by setting the ΔVbe across resistor 855 to be constant. In one example, the difference between input 544 and input 554 is a proportional to absolute temperature (PTAT) voltage. In one example, the input 544 is a complementary to absolute temperature (CTAT) voltage relative to ground and the input 554 is a CTAT voltage relative to ground.

In one example, the sum of current flow through resistor 581 is equal to the current flowing from output 521 of the transconductance amplifier 520 minus the current flowing from output 531 of transconductance amplifier 530. This difference current impresses a voltage I*R drop across resistor 581, according to the equation:

$$V_581 = I_\text{delta} * R581$$

where:

V_581=Voltage drop impressed across resistor 581

I_delta=difference current between amplifier outputs 521 and 531

In one example, the voltage I*R drop impressed across resistor 581 is adjustable (trimmable) and is controlled by the binary-encoded input vector trim<(n−1):0>. The input vector trim<(n−1):0> controls the current flowing from output 531 of transconductance amplifier 530 by controlling the number binary-encoded parallel current source elements, which combined, source current to the output 531. In one example, the bandgap output reference voltage can be adjusted, according to the following equation:

$$Vb\text{gap} = (1 + (2 * R581 + R584)/R585)\Delta Vbe + I2 * R581 + Vbe$$

where:

ΔVbe=delta Vbe voltage (PTAT)

Vbe=base emitter voltage of diode-connected transistor (CTAT)

I2=current of output 531 of transconductance amplifier 530

R581=resistor 581 resistance

R584=resistor 584 resistance

R585=resistor 585 resistance

In one example, the combination of a PTAT voltage and a CTAT voltage of the diode array DARRAY 560 provides a bandgap voltage Vbgap 590 which is stable over temperature and has a reduced voltage offset. In one example, the bandgap voltage Vbgap 590 is a reference voltage.

Figure 6:
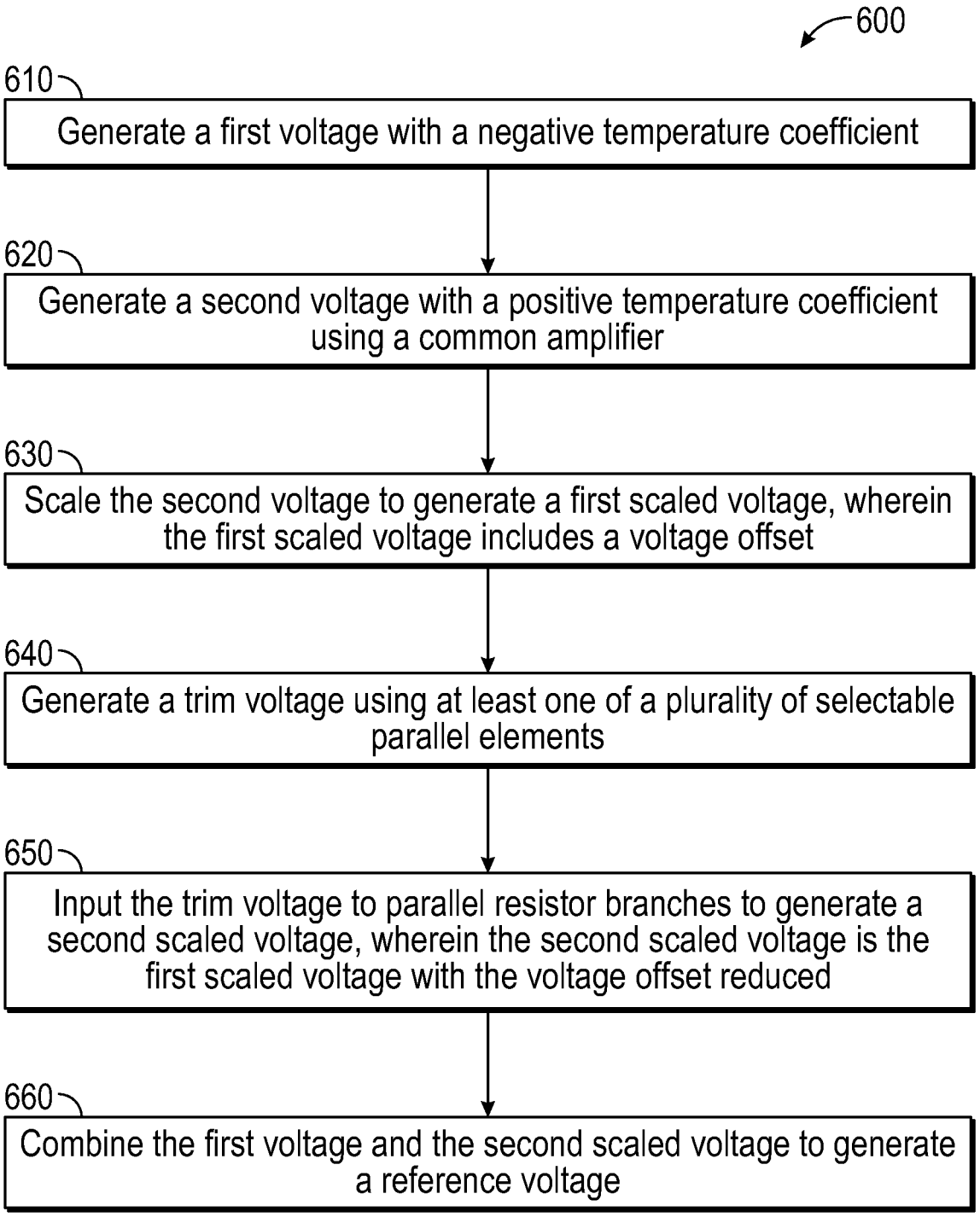
FIG. 6 illustrates an example of flow diagram for generating a precision bandgap reference with trim adjustment.

FIG. 6 illustrates an example of flow diagram 600 for generating a precision bandgap reference with trim adjustment. In block 610, generate a first voltage with a negative temperature coefficient. In one example, the first voltage may be generated by a bipolar junction transistor (BJT). In one example, the first voltage is a complementary to absolute temperature (CTAT) voltage.

In block 620, generate a second voltage with a positive temperature coefficient using a common amplifier. In one example, the second voltage may be generated by a pair of transistors with a N:1 emitter area ratio. In one example, the plurality of transistors with a N:1 emitter area ratio is part of a diode array, for example, the diode array (e.g., DARRAY 560). In one example, the second voltage is a proportional to absolute temperature (PTAT) voltage.

In block 630, scale the second voltage to generate a first scaled voltage, wherein the first scaled voltage includes a voltage offset. In one example, the voltage offset is a constant voltage offset. In one example, the first scaled voltage is generated using a differential error amplifier (e.g., differential error amplifier 510 shown in FIG. 5). In one example, the first scaled voltage is generated using a diode array.

In block 640, generate a trim current using at least one of a plurality of selectable parallel elements. In one example, the plurality of selectable parallel elements is binary weighted. In one example, the at least one of the plurality of selectable parallel elements is selected for usage using an n-bit binary word. In one example, the at least one of the plurality of selectable parallel elements is selected for usage prior to operational use. In one example, the trim current tracks the first scaled voltage over temperature.

In block 650, input the trim current to parallel resistor branches to generate a second scaled voltage. In one example, the second scaled voltage is the first scaled voltage with the voltage offset reduced. In one example, the trim current may be inputted to multiple parallel resistor branches to generate the second scaled voltage.

In block 660, combine the first voltage and the second scaled voltage to generate a reference voltage. In one example, the reference voltage is a bandgap voltage. In one example, the reference voltage is stable over temperature variation.

Figure 7:
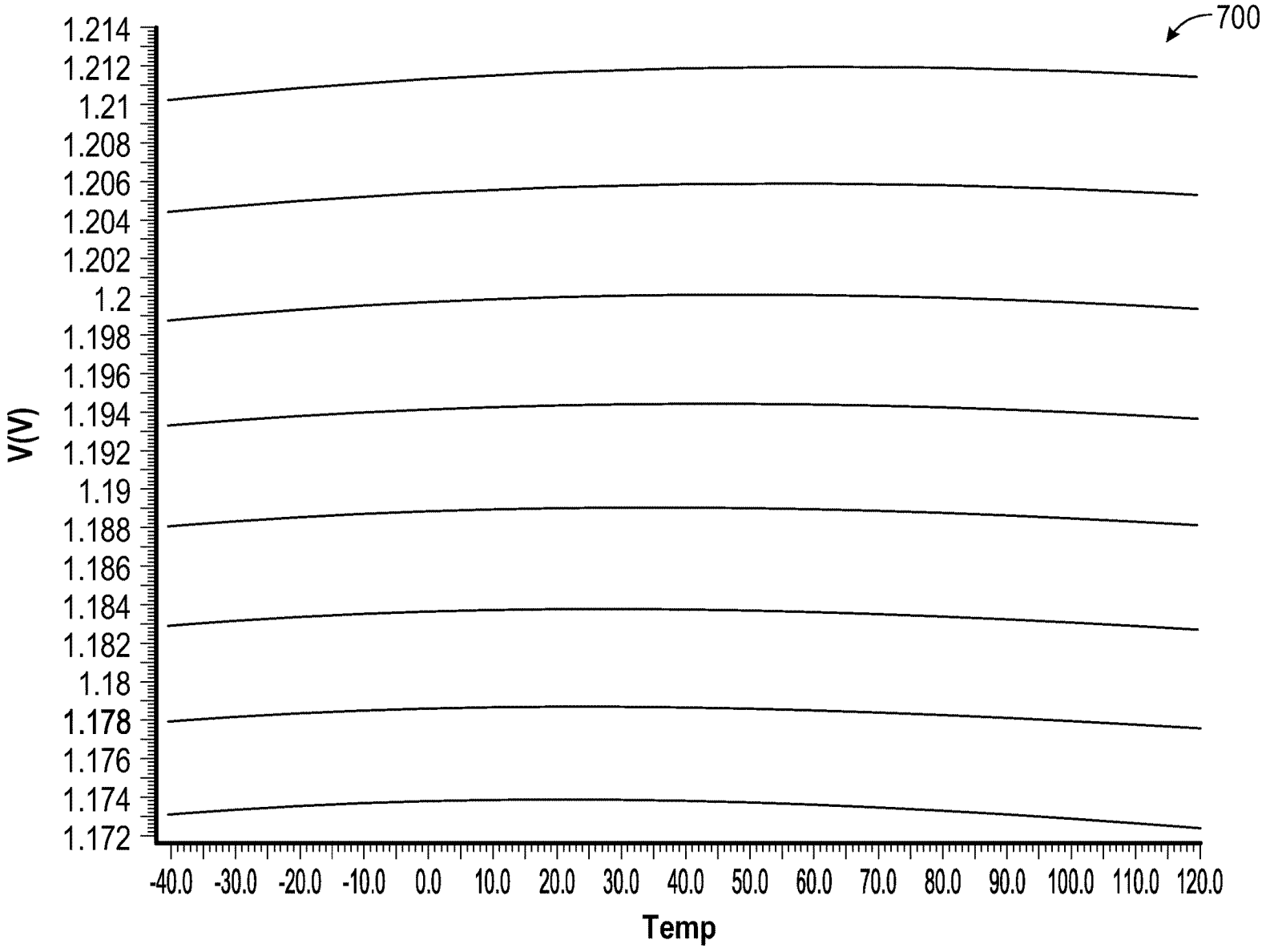
FIG. 7 illustrates example reference voltage curves vs. temperature which assumes a nominal semiconductor carrier mobility.

FIG. 7 illustrates example reference voltage curves vs. temperature 700 which assumes a nominal semiconductor carrier mobility. In the example of FIG. 7, the horizontal axis denotes temperature in degrees Celsius and the vertical axis denotes voltage in volts. For example, the reference voltage curves vs. temperature demonstrates good stability over a temperature range of −40 deg C. to 120 deg C.

Figure 8:
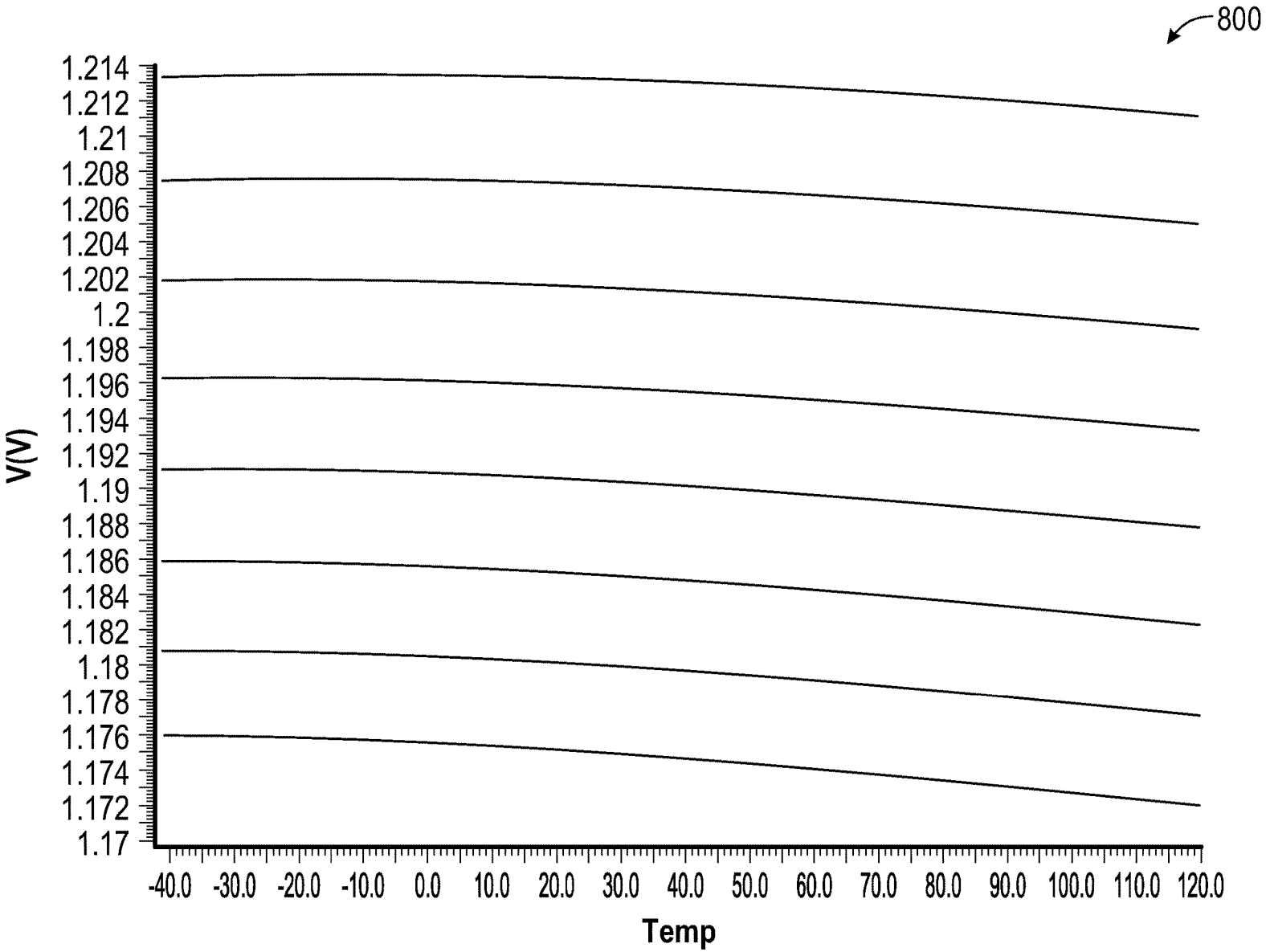
FIG. 8 illustrates example reference voltage curves vs. temperature which assumes a fast semiconductor carrier mobility.

FIG. 8 illustrates example reference voltage curves vs. temperature 800 which assumes a fast semiconductor carrier mobility. In the example of FIG. 8, the horizontal axis denotes temperature in degrees Celsius and the vertical axis denotes voltage in volts. For example, the reference voltage curves vs. temperature demonstrates good stability over a temperature range of −40 deg C. to 120 deg C.

Figure 9:
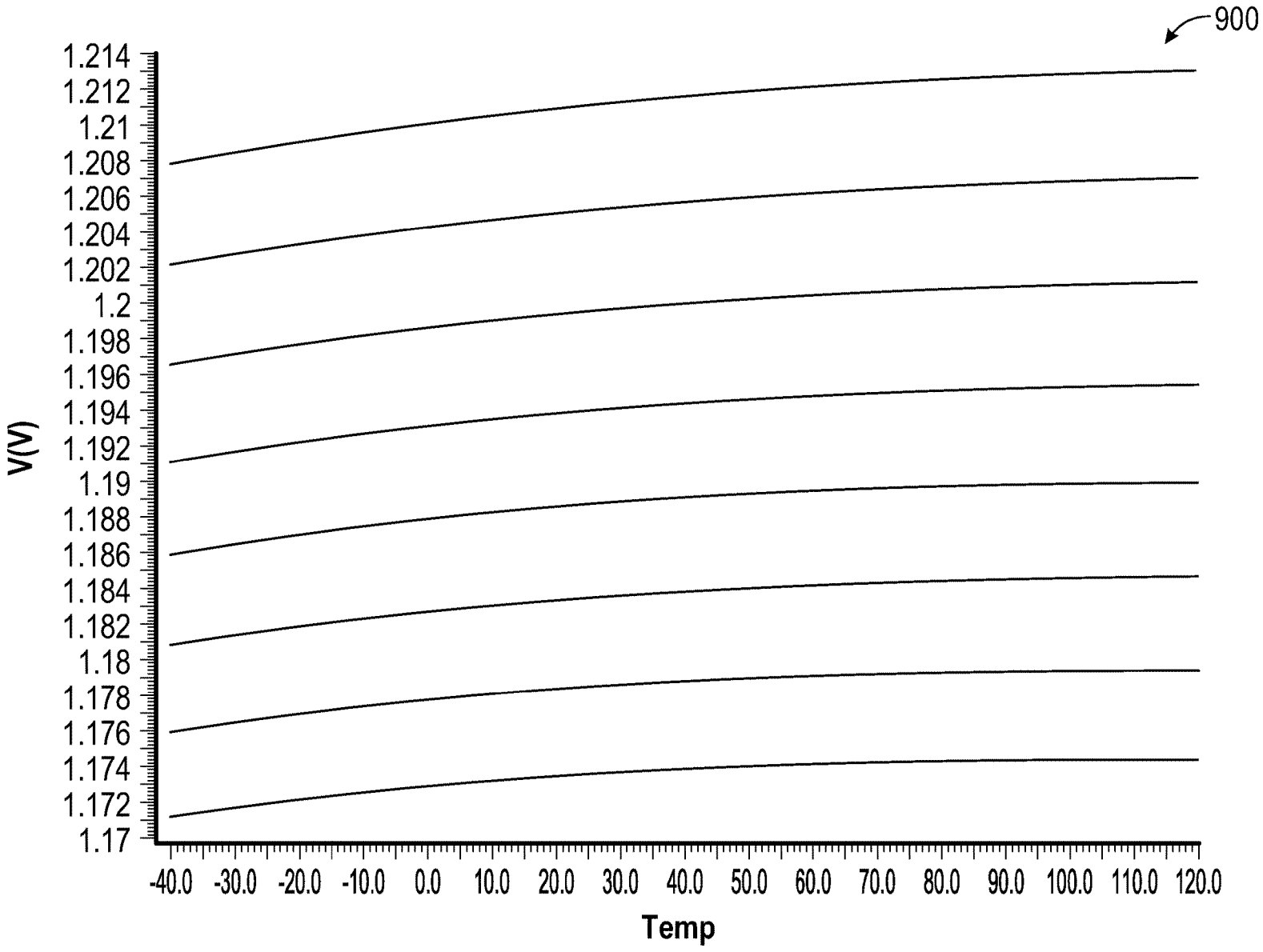
FIG. 9 illustrates example reference voltage curves vs. temperature which assumes a slow semiconductor carrier mobility.

FIG. 9 illustrates example reference voltage curves vs. temperature 900 which assumes a slow semiconductor carrier mobility. In the example of FIG. 9, the horizontal axis denotes temperature in degrees Celsius and the vertical axis denotes voltage in volts. For example, the reference voltage curves vs. temperature demonstrates good stability over a temperature range of −40 deg C. to 120 deg C.

In one aspect, one or more of the steps for generating a precision bandgap reference with trim adjustment in FIG. 6 may be executed by one or more processors which may include hardware, software, firmware, etc. In one aspect, one or more of the steps in FIG. 6 may be executed by one or more processors which may include hardware, software, firmware, etc. The one or more processors, for example, may be used to execute software or firmware needed to perform the steps in the flow diagram of FIG. 6. Software shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

The software may reside on a computer-readable medium. The computer-readable medium may be a non-transitory computer-readable medium. A non-transitory computer-readable medium includes, by way of example, a magnetic storage device (e.g., hard disk, floppy disk, magnetic strip), an optical disk (e.g., a compact disc (CD) or a digital versatile disc (DVD)), a smart card, a flash memory device (e.g., a card, a stick, or a key drive), a random access memory (RAM), a read only memory (ROM), a programmable ROM (PROM), an erasable PROM (EPROM), an electrically erasable PROM (EEPROM), a register, a removable disk, and any other suitable medium for storing software and/or instructions that may be accessed and read by a computer. The computer-readable medium may also include, by way of example, a carrier wave, a transmission line, and any other suitable medium for transmitting software and/or instructions that may be accessed and read by a computer. The computer-readable medium may reside in the processing system, external to the processing system, or distributed across multiple entities including the processing system. The computer-readable medium may be embodied in a computer program product. By way of example, a computer program product may include a computer-readable medium in packaging materials. The computer-readable medium may include software or firmware for generating a precision bandgap reference with trim adjustment. Those skilled in the art will recognize how best to implement the described functionality presented throughout this disclosure depending on the particular application and the overall design constraints imposed on the overall system.

Any circuitry included in the processor(s) is merely provided as an example, and other means for carrying out the described functions may be included within various aspects of the present disclosure, including but not limited to the instructions stored in the computer-readable medium, or any other suitable apparatus or means described herein, and utilizing, for example, the processes and/or algorithms described herein in relation to the example flow diagram.

Within the present disclosure, the word "exemplary" is used to mean "serving as an example, instance, or illustration." Any implementation or aspect described herein as "exemplary" is not necessarily to be construed as preferred or advantageous over other aspects of the disclosure. Likewise, the term "aspects" does not require that all aspects of the disclosure include the discussed feature, advantage or mode of operation. The term "coupled" is used herein to refer to the direct or indirect coupling between two objects. For example, if object A physically touches object B, and object B touches object C, then objects A and C may still be considered coupled to one another—even if they do not directly physically touch each other. For instance, a first die may be coupled to a second die in a package even though the first die is never directly physically in contact with the second die. The terms "circuit" and "circuitry" are used broadly, and intended to include both hardware implementations of electrical devices and conductors that, when connected and configured, enable the performance of the functions described in the present disclosure, without limitation as to the type of electronic circuits, as well as software implementations of information and instructions that, when executed by a processor, enable the performance of the functions described in the present disclosure.

One or more of the components, steps, features and/or functions illustrated in the figures may be rearranged and/or combined into a single component, step, feature or function or embodied in several components, steps, or functions. Additional elements, components, steps, and/or functions may also be added without departing from novel features disclosed herein. The apparatus, devices, and/or components illustrated in the figures may be configured to perform one or more of the methods, features, or steps described herein. The novel algorithms described herein may also be efficiently implemented in software and/or embedded in hardware.

It is to be understood that the specific order or hierarchy of steps in the methods disclosed is an illustration of exemplary processes. Based upon design preferences, it is understood that the specific order or hierarchy of steps in the methods may be rearranged. The accompanying method claims present elements of the various steps in a sample order, and are not meant to be limited to the specific order or hierarchy presented unless specifically recited therein.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language of the claims, wherein reference to an element in the singular is not intended to mean "one and only one" unless specifically so stated, but rather "one or more." Unless specifically stated otherwise, the term "some" refers to one or more. A phrase referring to "at least one of" a list of items refers to any combination of those items, including single members. As an example, "at least one of: a, b, or c" is intended to cover: a; b; c; a and b; a and c; b and c; and a, b and c. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for."

What is claimed is:

1. A method for generating a reference voltage with trim adjustment, the method comprising:

generating a trim current using at least one of a plurality of selectable parallel elements;

inputting the trim current to parallel resistor branches to generate a first scaled voltage;

combining a first voltage with the first scaled voltage to generate the reference voltage; and scaling a second voltage to generate a second scaled voltage, wherein the second scaled voltage includes a voltage offset, wherein the trim current tracks the second scaled voltage over temperature.

2. The method of claim 1, further comprising generating the first voltage, wherein the first voltage has a negative temperature coefficient.

3. The method of claim 2, further comprising generating the second voltage, wherein the second voltage has a positive temperature coefficient.

4. The method of claim 3, further comprising using a common amplifier for generating the second voltage.

5. The method of claim 1, wherein the first scaled voltage is the second scaled voltage with the voltage offset removed.

6. The method of claim 1, wherein the voltage offset is a constant voltage offset.

7. The method of claim 1, wherein the first voltage is a complementary to absolute temperature (CTAT) voltage.

8. The method of claim 7, wherein the second voltage is a proportional to absolute temperature (PTAT) voltage.

9. The method of claim 1, wherein the plurality of selectable parallel elements is selected for usage prior to an operational use.

10. The method of claim 9, wherein the plurality of selectable parallel elements is weighted.

11. The method of claim 10, further comprising using a n-bit binary word for selecting the at least one of the plurality of selectable parallel elements.

12. The method of claim 1, further comprising using a diode array for generating the first scaled voltage.

13. An apparatus for generating a reference voltage with trim adjustment, the apparatus comprising:

means for generating a trim current using at least one of a plurality of selectable parallel elements;

means for inputting the trim current to parallel resistor branches to generate a first scaled voltage;

means for combining a first voltage with the first scaled voltage to generate the reference voltage;

means for scaling a second voltage to generate a second scaled voltage, wherein the second scaled voltage includes a voltage offset; and means for removing the voltage offset from the second scaled voltage to generate the first scaled voltage.

14. The apparatus of claim 13, further comprising means for generating the first voltage, wherein the first voltage has a negative temperature coefficient.

15. The apparatus of claim 14, further comprising means for generating the second voltage, wherein the second voltage has a positive temperature coefficient.

16. The apparatus of claim 15, further comprising a common amplifier for generating the second voltage.

17. The apparatus of claim 13, further comprising a n-bit binary word for selecting the at least one of the plurality of selectable parallel elements, and a diode array for generating the first scaled voltage.

18. The apparatus of claim 13, wherein the first voltage is a complementary to absolute temperature (CTAT) voltage and the second voltage is a proportional to absolute temperature (PTAT) voltage.

19. A circuit for generating a reference voltage with trim adjustment, comprising:

a transconductance gain stage for generating a trim current using at least one of a plurality of selectable parallel elements, and for inputting the trim current to parallel resistor branches to generate a first scaled voltage;

a complementary to absolute temperature (CTAT) circuit for generating a first voltage, wherein the first voltage has a negative temperature coefficient;

a proportional to absolute temperature (PTAT) circuit for combining the first voltage with the first scaled voltage to generate the reference voltage, and wherein the proportional to absolute temperature (PTAT) circuit scales a second voltage to generate a second scaled voltage with a voltage offset;

a n-bit binary word for selecting the at least one of the plurality of selectable parallel elements; and a diode array for generating the first scaled voltage, wherein the proportional to absolute temperature (PTAT) circuit removes the voltage offset from the second scaled voltage to generate the first scaled voltage.

20. The circuit of claim 19, wherein the proportional to absolute temperature (PTAT) circuit generates the second voltage with a positive temperature coefficient.

21. The circuit of claim 20, wherein the proportional to absolute temperature (PTAT) circuit comprises a common amplifier for generating the second voltage.

* * * * *